US005365694A

United States Patent [19]

Macaluso

[11] Patent Number: 5,365,694

[45] Date of Patent: Nov. 22, 1994

[54] VEHICLE ANTI-THEFT PARKING SPACE DEVICE

[76] Inventor: Ignazio Macaluso, 921 E. 98th St., Brooklyn, N.Y. 11236

[21] Appl. No.: 53,261

[22] Filed: Apr. 27, 1993

[51] Int. Cl.[5] ..... E01F 13/00

[52] U.S. Cl. ..... 49/49; 49/131

[58] Field of Search ..... 49/35, 49, 131

[56] References Cited

U.S. PATENT DOCUMENTS

| | | | |
|---|---|---|---|
| 3,660,935 | 5/1972 | Boots | 49/49 |
| 3,698,135 | 10/1972 | Boots et al. | 49/49 |
| 4,003,161 | 1/1977 | Collins | 49/49 |
| 4,062,149 | 12/1977 | Collins | 49/49 |
| 4,576,508 | 3/1986 | Dickinson | 49/49 |
| 4,577,991 | 3/1986 | Rolow | 49/49 |
| 4,666,331 | 5/1987 | Riley | 49/49 |
| 4,715,742 | 12/1987 | Dickinson | 49/49 |
| 4,919,563 | 4/1990 | Stice | 49/49 |
| 5,054,237 | 10/1991 | Kapala et al. | 49/49 |
| 5,070,646 | 12/1991 | Colombo | 49/49 |
| 5,192,159 | 3/1993 | Higginson | 49/49 |

*Primary Examiner*—Michael J. Milano
*Attorney, Agent, or Firm*—Goodman & Teitelbaum

[57] ABSTRACT

A vehicle anti-theft parking space device including a vertically slideable post telescopingly received in a receptacle base securely mounted underground from ground level in a driveway and the like so that the post can be raised and locked in the raised position above ground level by a padlock to prevent unauthorized movement of a vehicle parked on the driveway. A spring mechanism is disposed between the post and the receptacle base to maintain the post in the raised position in a vertical alignment with the receptacle base. A hasp is pivotally mounted within the post so that the hasp can freely pivot through a slot in the post into a horizontal position extending outwardly from the post, and secured in the horizontal position by the padlock so that the post cannot be lowered into the receptacle base. The hasp is pivoted back into the post, when the padlock is removed, as the post is being lowered into the receptacle base. A handle is provided for pulling the post up to the raised position. Retainment members are provided on the receptacle base for securing the receptacle base in the ground. A stop is provided to prevent the post from being pulled out of the receptacle base. Preferably, the post is an elongated square shaped hollow member, and the receptacle base is an elongated rectangular shaped hollow member.

19 Claims, 3 Drawing Sheets

VEHICLE ANTI-THEFT PARKING SPACE DEVICE

BACKGROUND OF THE INVENTION

The invention relates to an anti-theft device, and more particularly, to a vehicle anti-theft parking space device including a vertically slideable post that is telescopingly received in a receptacle base securely mounted underground from ground level in a driveway and the like so that the post can be raised and locked in the raised position above ground level by a padlock to prevent unauthorized movement of a vehicle parked on the driveway.

Vehicle anti-theft devices including a post to prevent unauthorized movement of a vehicle parked on a driveway and the like are well known in the art. Many of these prior art anti-theft devices include springs, levers and pulley mechanisms in order to raise and lower the post. Furthermore, many of these prior art anti-theft devices are not reliable, are too expensive, and/or are constructed in such a manner that they are difficult to handle in a proper manner by the user thereof.

U.S. Pat. No. 2,588,502 discloses a parking way control system including a telescoping post that is raised and lowered by a bar connected to a lever-spring device which is activated by weight responsive means operated by the vehicle passing thereover.

U. S. Pat. No. 3,451,164 discloses a vehicle parking device including a telescoping post that is raised and lowered by pulleys and springs, the post being locked by a key locking device mounted in a top portion of the post.

U.S. Pat. No. 3,564,769 discloses an anti-theft device that includes a telescoping post and receptacle base therefor, each having a square configuration, where the post is secured to the receptacle base in the pulled-up position by a lock mounted in a handle of the post.

U.S. Pat. No. 3,660,935 discloses a vehicle parking space locking device including a telescoping post which is pulled up by a handle and secured to a housing by a lever controlled by a key lock mounted in the housing.

U.S. Pat. No. 3,698,135 discloses a vehicle parking space locking device including a telescoping post which is locked in a raised position by a pulley system controlled by two key locks mounted in the top wall of the post.

U.S. Pat. No. 3,925,929 discloses a parking space barrier including a post which is pivoted from the ground to an upright position, and is locked to a ground support by a lever controlled by a key lock mounted in an upper portion of the post.

U.S. Pat. No. 4,003,161 discloses a mechanical barrier including a telescoping post which is secured to a receptacle base by a lever system controlled by a key lock mounted in the top wall of the post, where in a modified form, a latch member connected to the lever system is locked in place in the top portion of the post by a padlock.

U.S. Pat. No. 4,062,149 discloses a parking space barrier including a removable post which is secured to a receptacle base by a lever locked in place on the post by a padlock.

U.S. Pat. No. 4,576,508 discloses a bollard trafficway barrier and vehicle arrest system including a post which is raised and lowered by hydraulic operation thereof.

Accordingly, there is presently a need for a reliable reasonably priced anti-theft device including a telescoping post to prevent unauthorized movement of a vehicle parked on a driveway that can be easily mounted in the driveway, that has few parts, that permits the post to be easily moved up and down by an authorized person, and that permits the post to be conveniently locked in the raised position by a convention padlock.

SUMMARY OF THE INVENTION

It is accordingly an object of the present invention to provide a vehicle anti-theft device which avoids the problems of the prior art devices.

Another object of the present invention is to provide a vehicle anti-theft device including a vertically slideable post that is telescopingly received in a receptacle base securely mounted underground from ground level in a driveway and the like so that the post can be raised and locked in the raised position above ground level to prevent unauthorized movement of a vehicle parked on the driveway.

A further object of the present invention is to provide a vehicle anti-theft device including spring means disposed between the post and the receptacle base to maintain the post in the raised position, disposed in a vertical alignment with the receptacle base.

Still another object of the present invention is to provide a vehicle anti-theft device including a hasp pivotally mounted within the post so that the hasp can be pivoted through a slot in the post into a horizontal position, and secured in the horizontal position by a padlock so that the post cannot be lowered into the receptacle base.

Another object of the present invention is to provide a vehicle anti-theft device including a handle for pulling the post up to the raised position.

A further object of the present invention is to provide a vehicle anti-theft device including retainment means provided on the receptacle base for fixedly securing the receptacle base in the ground.

A still further object of the present invention is to provide a vehicle anti-theft device including stop means to prevent the post from being pulled out of the receptacle base.

Still another object of the present invention is to provide a vehicle anti-theft device, that can be economically manufactured to be reasonably priced, that has few parts, that is reliable, that can be easily mounted in a driveway so that the post can be easily moved up and down by a authorized person, and that permits the post to be conveniently locked in the raised position by a conventional padlock.

Briefly, in accordance with the present invention, there is provided a vehicle anti-theft parking space device including a vertically slideable post telescopingly received in a receptacle base securely mounted underground from ground level in a driveway and the like so that the post can be raised and locked in the raised position above ground level by a padlock to prevent unauthorized movement of a vehicle parked on the driveway. Spring means are disposed between the post and the receptacle base to maintain the post in the raised position in a vertical alignment with the receptacle base. A hasp is pivotally mounted within the post so that the hasp can freely pivot through a slot in the post into a horizontal position extending outwardly from the post, and secured in the horizontal position by the padlock so that the post cannot be lowered into the receptacle base. The hasp is pivoted back into the post, when the padlock is removed, as the post is being lowered into the receptacle base. A handle is provided for pulling the post up to the raised position. Retainment means are provided on the receptacle base for fixedly securing the receptacle base in the ground. Stop means are provided to prevent the post from being pulled out of the receptacle base. Preferably, the post is an elongated square shaped hollow member, and the receptacle base is an elongated rectangular shaped hollow member.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

In the various figures of the drawings, like reference characters designate like parts.

DESCRIPTION OF THE PREFERRED EMBODIMENTS

Figure 1:
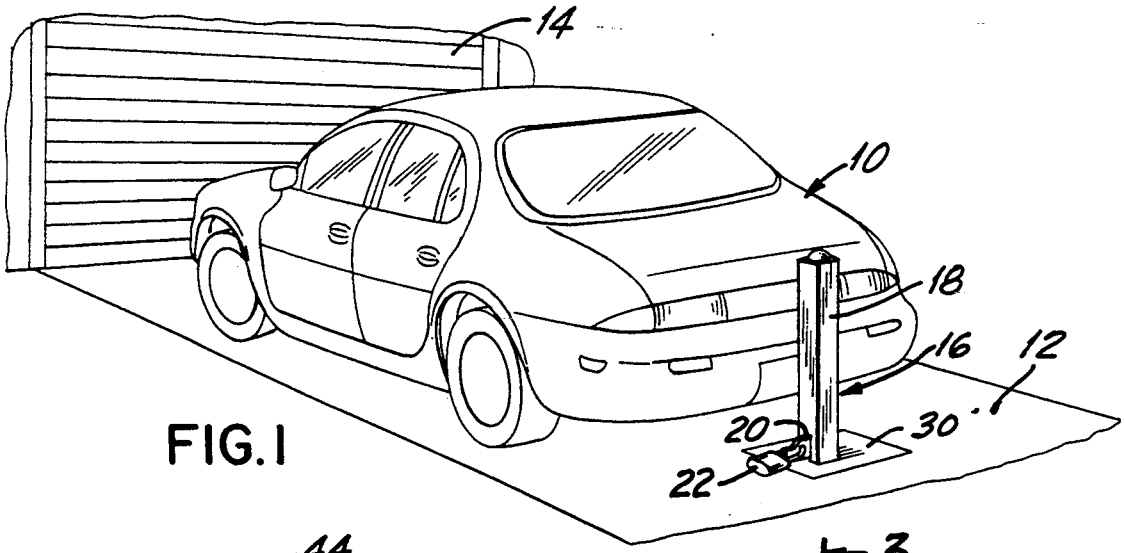
FIG. 1 is a fragmented perspective view of the vehicle anti-theft parking space device, in accordance with the present invention, mounted in a driveway to prevent unauthorized movement of a vehicle parked on the driveway.

Referring now to the drawings, FIG. 1 shows a conventional vehicle 10 parked on a conventional driveway 12 so that a forward motion of the vehicle 10 is prevented by a conventional garage door 14 in the closed position. A vehicle anti-theft parking space device 16 is mounted in the driveway 12 to the rear of the vehicle 10 to prevent rearward movement of the vehicle 10 so that the vehicle 10 cannot be moved off the driveway 12 by an unauthorized person attempting a theft thereof.

Figure 2:
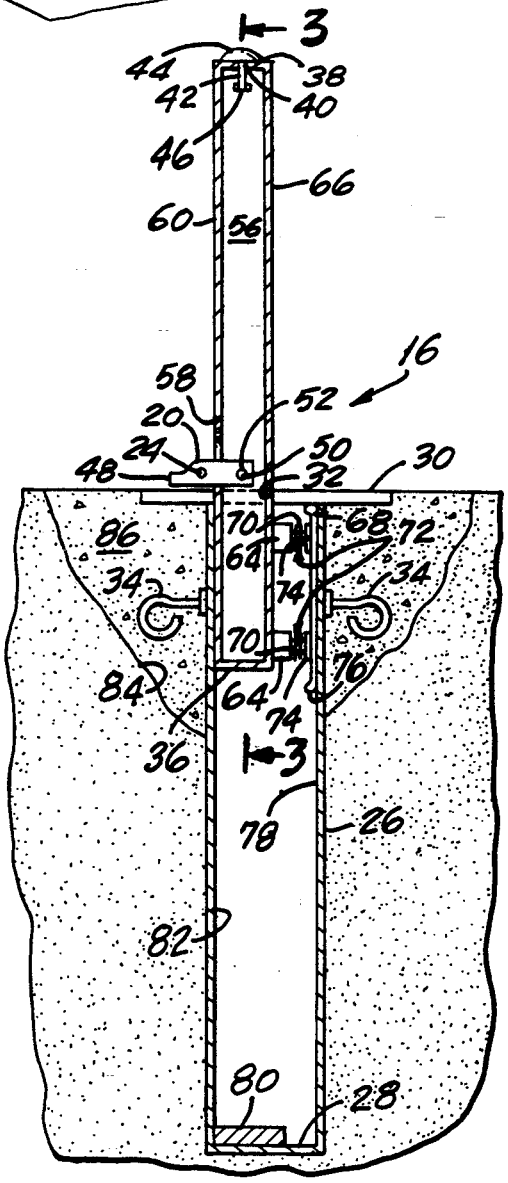
FIG. 2 is a fragmented cross sectional view of the vehicle anti-theft parking space device shown in FIG. 1.

A portion of the device 16 is secured in the ground below the driveway 12, as will be set forth below, at a predetermined distance from the garage door 14, this predetermined distance being slightly larger than the length of the vehicle 10. Accordingly, a post 18 of the device 16 is in a raised position above ground level to prevent the rearward movement of the vehicle 10. The post 18 includes a pivotal hasp 20 which is pivoted outwardly from the post 18 when the post 18 is in the raised position, as shown in FIG. 2. A conventional padlock 22, being either a key operated or combination type padlock, is engaged through a hole 24 in the hasp 20 to prevent the post 18 from being lowered into a telescoped retracted position, as set forth below.

Obviously, the device 16 can be used in other situations other than on a driveway. Accordingly, if only one device 16 is being used at one end of the vehicle 10, then a barrier such as a fence, a wall and the like must be disposed at the other end of the vehicle 10 to prevent both forward and rearward movement thereof. However, in a situation where there is no barrier, then two devices 16 can be used, one device 16 mounted in front of the vehicle 10 and the other device 16 mounted to the rear of the vehicle 10, thereby sandwiching the vehicle 10 therebetween.

Figure 3:
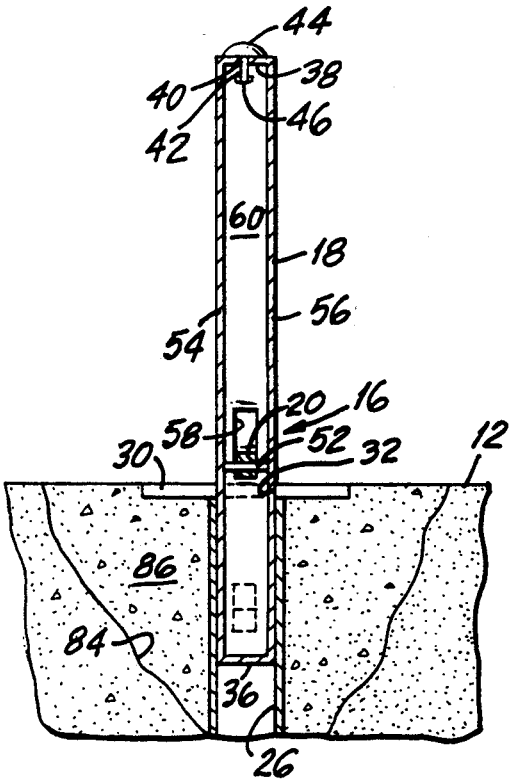
FIG. 3 is a sectional view taken substantially along line 3—3 of FIG. 2.
Figure 6:
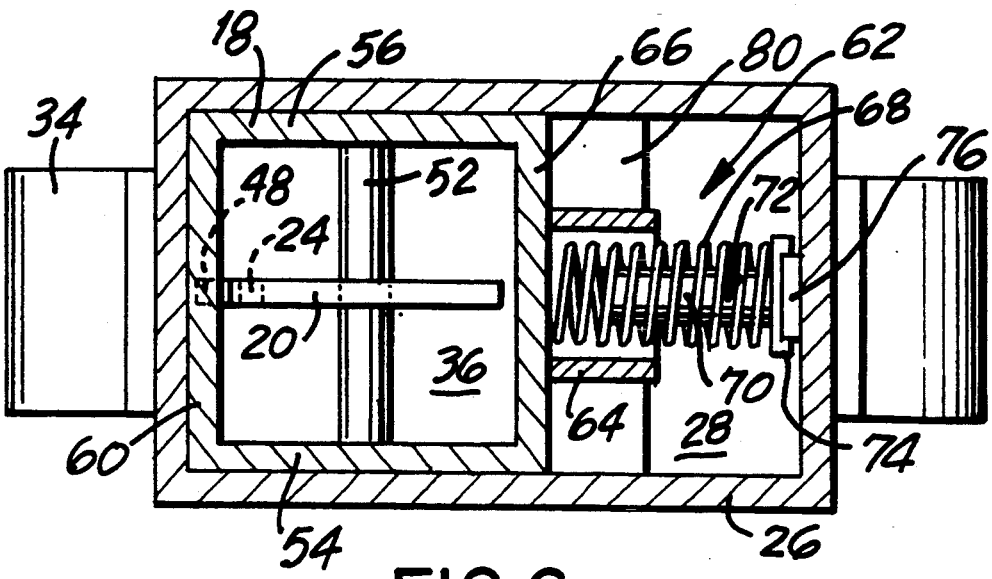
FIG. 6 is a sectional view taken substantially along line 6—6 of FIG. 4.

As shown in FIGS. 2 and 3, the post 18 is slidably mounted for up and down movement in a receptacle base 26. Preferably, the post 18 has a square transverse cross section and the receptacle base 26 has a rectangular transverse cross section, as best shown in FIG. 6, however it is understood that the post 18 and/or the receptacle base 26 could have other types of transverse cross sections, such as circular. The receptacle base 26 is an elongated hollow member having a bottom wall 28 closing the bottom end thereof. The upper end of the receptacle base 26 is closed by an enlarged rectangular plate 30. The enlarged plate 30 has a square opening 32 to receive the post 18 therethrough. A pair of retainment members 34 are mounted on opposite outer surfaces of the receptacle base 26. The retainment members 34 have a non-linear shape, such as a curved shape, the function of which will be described below.

The post 18 is also an elongated hollow member having a bottom wall 36 closing the bottom end thereof, and a top wall 38 closing the top end thereof. The top wall 38 has an opening 40 therein to slidably receive a shank 42 of a pull-up handle 44. The free end 46 of the shank 42 is enlarged to retain the shank 42 within the hole 40 when the handle 44 is pulled up, so that the handle 44 cannot be removed from the post 18, as set forth below.

The hasp 20 is an elongated bar-like member having a tongue portion 48 on one end thereof adjacent to the hole 24, and a hole 50 in the opposite end thereof to receive a pin or bar 52 therethrough so that the hasp 20 can pivot around the pin 52. The pin 52, as best shown in FIGS. 3 and 6, is disposed in a horizontal position with the opposite ends thereof being secured by conventional means to the opposite inner surfaces of the side walls 54, 56 of the post 18. A vertically extending, centrally positioned slot 58 is provided in the front wall 60 to receive the tongue portion 48 and the hole 24 of the hasp 20 therethrough, as shown in FIG. 2, as will be explained below.

Figure 4:
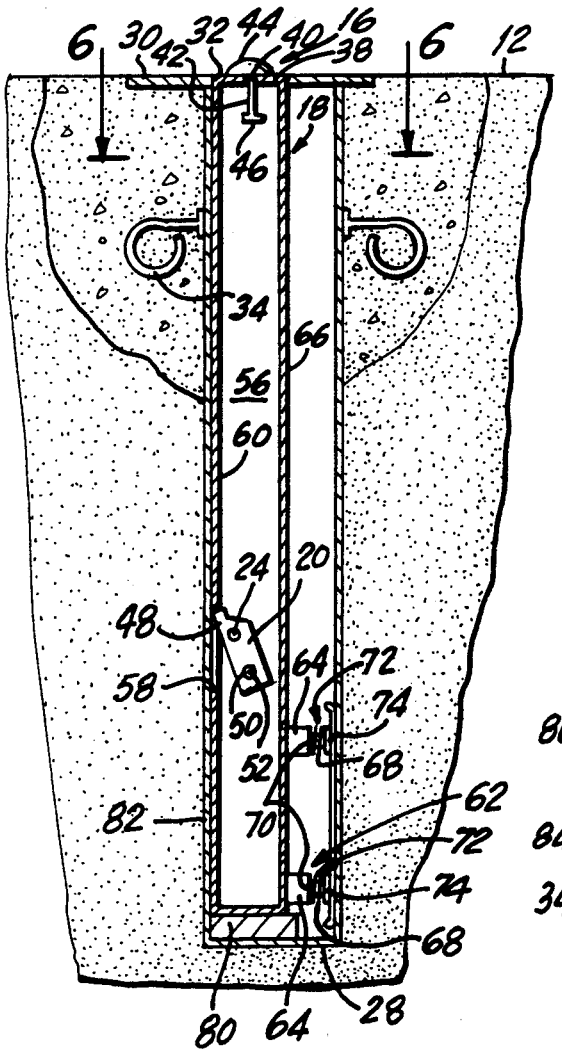
FIG. 4 is a fragmented cross sectional view showing the vehicle anti-theft parking space device in a telescoped retracted position.

Additionally, the post 18 is provided with spring means 62 to maintain the post 18 in its raised position. As best shown in FIGS. 2, 4 and 6, the spring means 62 includes a spaced apart pair of open ended circular housings 64 secured by conventional means to the bottom portion of the rear wall 66 of the post 18 in a vertical alignment with each other. A separate coil spring 68 is received in each housing 64 so that one end thereof engages against the rear wall 66 and extends out through the open end of the housing 64. Each of the coil springs 68 receives a shaft 70 of a plunger 72 so that the opposite end of the coil spring 68 engages against the head 74 of the plunger 72. Thus, the free end of the shaft 70 is spaced from the rear wall 66 of the post 18 by the action of the coil spring 68.

Each of the heads 74 of the plungers 72 are secured by conventional means to a slide member 76 in the same spaced apart vertical alignment as the housings 64. The coil springs 68 force the slide member 76 against the rear wall 78 of the receptacle base 26, and permit the slide member 76 to slide against the rear wall 78 when the post 18 is vertically raised and lowered. It is noted, that the tension of the coil springs 68 is sufficient to maintain the post 18 in the raised position above ground level, as shown in FIG. 2.

Furthermore, the spring means 62 maintain the post 18 in a vertical aligned position with the receptacle base 26, both in the raised position shown in FIG. 2 and the telescoped retracted position shown in FIG. 4. It is also noted, that a spacer block 80 is secured to the bottom wall 28 of the receptacle base 26 at a predetermined spaced distance from the rear wall 78 to provide a clearance for the bottom of the slide member 76 when the bottom wall 36 of the post 18 rests on the spacer block 80 in the telescoped retracted position of the post 1.8, as shown in FIG. 4. It should also be noted, that the upper end of the slide member 76 engages the plate 30 when the post 18 is pulled up to its raised position, as shown in FIG. 2, thus functioning as a stop to prevent the post 18 from being pulled out of the receptacle base 26.

Before installing the device 16, the device 16 is fully assembled. In the assembly thereof the spacer block 80 is secured to the bottom wall 28 of the receptacle base 26, and the retainment members 34 are secured on opposite walls of the receptacle base 26, as mentioned above. The handle 44 is secured to the top wall 38 of the post 18, and the pin 52 with the hasp 20 pivotally mounted thereon, is secured within the post 18 in alignment with the post slot 58, as mentioned above. Then the spring means 62 are mounted on the post 18, in the manner set forth above.

The post 18 and the spring means 62 are then slidingly inserted into the open top end of the receptacle base 26 so that the upper portion of the post 18 , above the slot 58, extends outwardly from the receptacle base 26. Thereafter, the upper portion of the post 18 is inserted through the square opening 32 in the enlarged rectangular plate 30, and the plate 30 is moved along the post 18 to engage with the open top end of the receptacle base 26. The plate 30 is then secured by conventional means to the top end of the receptacle base 26 to enclose the spring means 62 therein while permitting the vertical up and down movement of the post 18. The assembly procedure is now complete.

For the installation thereof to secure the receptacle base 26 in the ground below the driveway 12, a rectangular hole 82, approximately equal to the length of the receptacle base 26 from the bottom wall 28 to the plate 30, is formed through the driveway 12 into the ground below. Then, the upper end of the hole 82 is enlarged to form an irregular cavity 84, the cavity 84 being large enough to receive the retainment members 34 therein. The receptacle base 26 of the assembled device 16 is then inserted into the hole 82 to a predetermined underground position so that the upper surface of the plate 30 is at ground level with the upper surface of the driveway 12, where obviously adjustments can be made in the positioning of the receptacle base 26 to ensure same. Thereafter, the cavity 84 is filled with concrete 86, cement or the like, where the concrete 86 encloses around the retainment members 34 for securement therein. Thus, when the concrete 86 has hardened, the retainment members 34 are securely fixed in the concrete 86 to prevent the receptacle base 26 from being pulled out of the ground. The installation is now complete.

With the receptacle base 26 secured in the ground, the post 18 is free to move vertically up and down therein. However, with the hasp 20 in the horizontal position, as shown in FIG. 2, and with the padlock 22 locked on the hasp 20, as shown in FIG. 1, the padlock 22 prevents the hasp 20 from being pivoted back into the post 18. Therefore, the hasp 20 with the padlock 22 locked thereon prevents the post 18 from being pushed down telescopically into the receptacle base 26. Accordingly, to permit the vehicle 10 to be backed off the driveway 12, the authorized person must first remove the padlock 22 from the hasp 20. Thereafter, the authorized person merely pushes down on the post 18, thereby causing the plate 30 to freely pivot the hasp 20 through the slot 58 into the post 18 as the post 18 is being moved downwardly through the plate 30 to the telescoped retracted position shown in FIG. 4.

It is noted, that the tongue portion 48 of the hasp 20 is disposed in the slot 58 against the inner surface of front side wall of the receptacle base 26 when the post 18 is pushed down past the plate 30, as shown in FIG. 4, as will further be explained below. Furthermore, due to the weight distribution of the hasp 20 and the distance between the tongue portion 48 and the pin 52, the tongue portion 48 does not pivot to or beyond a vertical position directly above the pin 52, but rather the hasp 20 remains in an inclined position leaning towards the slot 58. Accordingly, means can be provided to ensure the inclined position of the hasp 20, as set forth below.

Figure 5:
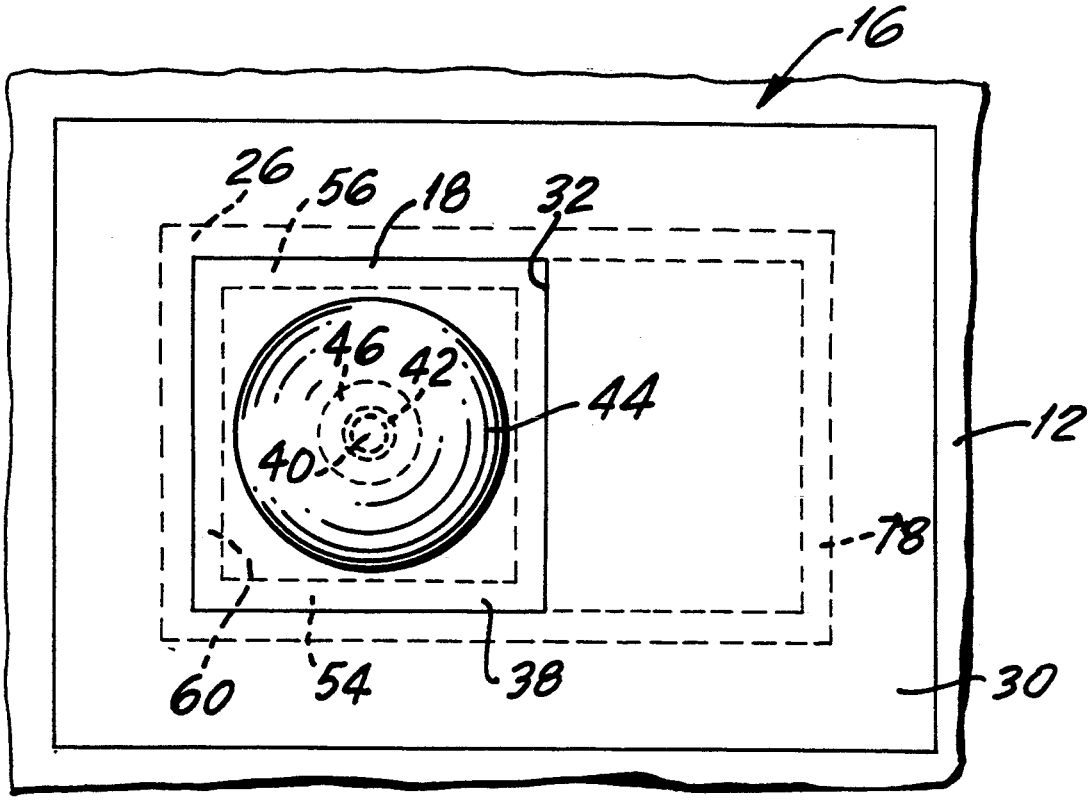
FIG. 5 is a fragmented top plan view of the vehicle anti-theft parking space device shown in FIG. 4.

As shown in FIGS. 4 and 5, the handle 44 is circular so that there are no sharp corners, where the top surface of the handle 44 is curved also to avoid any sharp corners. Thus, when the post 18 is in the telescoped retracted position, the tires of the vehicle can easily ride over the handle 44, and a person can step on the handle 44 without causing any damage to the tires or the person, thus avoiding any hazardous situations.

Figure 7:
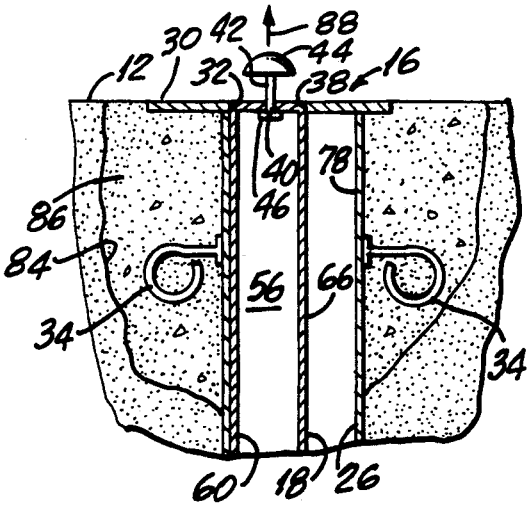
FIG. 7 a fragmented cross sectional view, similar to FIG. 4, showing the handle of the vehicle anti-theft parking space device in a raised position.

Accordingly, when it is desired to raise the post 18, the person merely grasps the handle 44 and pulls up in the direction of arrow 88, as shown in FIG. 7, until the handle 44 is spaced from the plate 30 by the shank 42 thereof sliding through the hole 40 in the top wall 38 of the post 18. The person now moves his or her fingers under the handle 44, into the space now provided, to grasp the handle 44 and pulls upwardly so that the enlarged free end 46 of the shank 42 engages the top wall 38 and raises the post 18 to the raised position shown in FIG. 2. Once the slot 58 starts to pass (in an upwardly direction) the plate 30, the hasp 20 becomes disengage from the front wall of the receptacle base 26 and begins to freely pivot downwardly in a counterclockwise direction as viewed in FIG. 2, until the hasp 20 is in the horizontal position above the plate 30 when the slot 58 has cleared the plate 30. The spring means 62 now maintains the post 18 in the raised position so that the person can lock the padlock 22 on the hasp 20. The above-mentioned procedure is followed for lowering the post 18.

Figure 8:
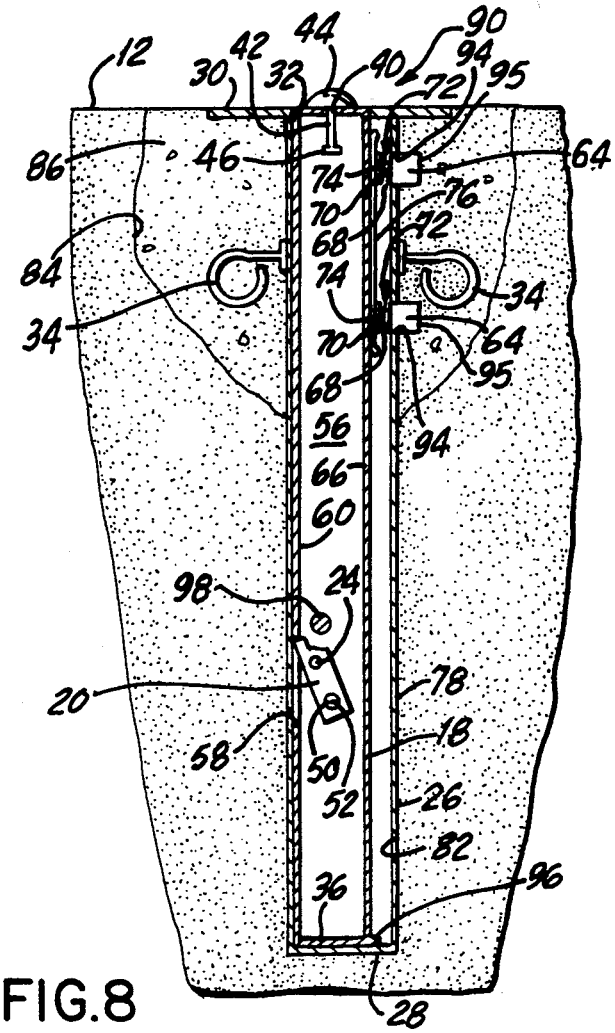
FIG. 8 is a fragmented sectional view, similar to FIG. 4, showing a modified vehicle anti-theft parking space device.

FIG. 8 shows a modified vehicle anti-theft parking space device 90 which is substantially the same as the above device 16 except for the following modifications. The spring means 62 of the device 16 for maintaining the post 18 in the vertical position has been modified as spring means 92 for performing the same function. The spring means 92 includes the same parts as the above-mentioned spring means 62, however unlike the spring means 62 which is connected to the post 18 for movement therewith, the spring means 92 is connected to the receptacle base 26 and remains in a fixed stationary position thereon.

As shown in FIG. 8, the open end of each of the spaced apart pair of circular housings 64 is secured by conventional means to the outer surface of the rear wall 78 of the receptacle base 26 in alignment with a pair of associated holes 94 provided in the rear wall 78. Each of the heads 74 of the plungers 72 are still secured by conventional means to the slide member 76 in the same spaced apart vertical alignment as the housings 64 as mentioned above. The free end of each shaft 70 of the plungers 72 are disposed in an associated one of the housings 64 by passing through an associated one of the holes 94 in the rear wall 78. Accordingly, one of the coil springs 68 is mounted on each shaft 70 so that one end of each coil spring 68 engages against the head 74 of each plunger 72, and the opposite end of each coil spring 68 engages against the closed opposite end 95 of each housing 64, where each coil spring 68 also extends through an associated one of the holes 94 in the rear wall 78.

Thus, the coil springs 68 act on the heads 74 to force the slide member 76 against the rear wall 66 of the post 18. The force of the coil springs 68 permits the slide member 76 to slide against the rear wall 66 of the post 18 when the post 18 is being vertically raised and lowered. However, the tension of the coil springs 68 is sufficient to maintain the post 18 in the raised position above ground level similar to the position shown in FIG. 2. Additionally, the stationary spring means 62 maintains the post 18 in a vertical aligned position, with respect to the receptacle base 26, both in the raised position similar to the showing of FIG. 2, and in the telescoped retracted position shown in FIG. 8.

In another modification provided in the device 90, a rearwardly extending horizontal flange 96 is secured to the bottom wall 36 of the post 18 in vertical alignment with the slide member 76. Accordingly, when the post 18 is raised, the horizontal flange 96 engages the bottom of the slide member 76 when the slot 58 in the front wall 60 of the post 18 has completely passed upwardly through the opening 32 in the plate 30. Thus, the horizontal flange 96 functions as a stop to prevent the post 18 from being pulled completely out of the receptacle base 26, where the horizontal flange 96 positions the slot 58 so that the hasp 20 can pivot therethrough into the horizontal position in the manner mentioned above. It is noted, that the spacer block 80 in the receptacle base 26 of the device 16 is not required in the device 90.

A further modification provided in the device 90, as indicated above, includes a pin or bar 98 horizontally secured by conventional means to the side walls 54, 56 of the post 18. The pin 98 is positioned adjacent to the upper wall of the slot 58, being spaced between the slot 58 and the hasp pin 52 as shown in FIG. 8. Accordingly, the pin 98 functions as a stop which engages the tongue portion 48 of the hasp 20 when the hasp 20 is pivoted back into the post 18. Thus, the pin 98 prevents the tongue portion 48 from pivoting to or passed a vertical position directly above the pin 52, so that the hasp 20 is forced to remain in the inclined position, when disposed in the post 18, leaning into the slot 58 against the inner surface of the front wall of the receptacle base 26, as shown in FIG. 8.

The other parts of the device 90 are substantially similar to the parts of the device 16, and function in the same manner, so that a further description thereof is not thought necessary.

Numerous alterations of the structures her discussed will suggest themselves to those skilled in the art. However, it is to be understood that the present disclosure relates to preferred embodiments of the invention which are for purposes of illustration only, and are not to be construed as a limitation of the invention.

What is claimed is:

1. A vehicle anti-theft parking space device, comprising:

a hollow receptacle base for mounting underground in a vertical position extending downwardly from ground level;

a vertically slideable hollow post telescopingly received in said receptacle base so that said post can be lowered into said receptacle base to a telescoped retracted position and raised out of said receptacle base to a raised position above ground level;

said post including a vertically extending slot provided through a wall of a lower portion of said post, said slot being positioned within said receptacle base when said post is in said telescoped retracted position, and said slot being positioned out of said receptacle base adjacent to an upper portion of said receptacle base when said post is in said raised position;

hasp means for engaging said receptacle base to prevent said post from being telescopingly retracted into said receptacle base, said hasp means including a hasp pivotally mounted within said post, said hasp being an elongated bar-like member having .a first hole at one end thereof to receive a pin secured within said post so that said hasp can pivot around said pin, a tongue portion being provided on an opposite free end of said hasp, and a second hole being provided longitudinally between said first hole and said tongue portion;

said hasp being in an inclined position within said post when said post is in said telescoped retracted position, and said hasp being in a horizontal position extending outwardly from said post when said post is in said raised position;

said pin being transversely spaced from said slot so that said hasp freely pivots around said pin from said inclined position within said post, through said slot into said horizontal position to extend outwardly from said post;

said tongue portion and said second hole being disposed out of said post when said hasp is in said horizontal position; and locking means for securing said hasp in said horizontal position so that said free end of said hasp engages said upper portion of said receptacle base to prevent said post from being lowered into said receptacle base, said locking means being removably engaged through said second hole in said hasp.

2. A vehicle anti-theft parking space device according to claim 1, wherein stop means are provided in said post to prevent said hasp from pivoting passed a vertical position of said hasp directly above said pin.

3. A vehicle anti-theft parking space device according to claim 1, wherein said post is provided with handle means for pulling said post up to said raised position.

4. A vehicle anti-theft parking space device according to claim 3, wherein said handle means includes a handle portion having a curved configuration to avoid any sharp corners, one end of a shank being connected to a bottom surface of said handle portion, said shank extending through a hole in a top wall of said post, an opposite free end of said shank being enlarged to prevent removal of said shank from said post when said handle portion is pulled up.

5. A vehicle anti-theft parking space device according to claim 1, wherein said post has a square transverse cross section, and said receptacle base has a rectangular transverse cross section.

6. A vehicle anti-theft parking space device according to claims 5, wherein an upper end of said receptacle base is closed by an enlarged rectangular plate, said plate having a square opening to receive said post therethrough.

7. A vehicle anti-theft parking space device according to claim 1, wherein said receptacle base is provided with retainment means for fixedly securing said receptacle base in the ground.

8. A vehicle anti-theft parking space device according to claim 1, including stop means to prevent said post from being pulled completely out of said receptacle base.

9. A vehicle anti-theft parking space device according to claim 8, wherein said stop means includes a slide member mounted on said post for engaging an upper end of said receptacle base.

10. A vehicle anti-theft parking space device according to claim 9, wherein said slide member is connected to spring means for maintaining said post in said raised position.

11. A vehicle anti-theft parking space device according to claim 8, wherein said stop means includes a slide member mounted in said receptacle base for engaging a lower end of said post.

12. A vehicle anti-theft parking space device according to claim 11, wherein said slide member is connected to spring means for maintaining said post in said raised position.

13. A vehicle anti-theft parking space device according to claim 1, including engagement means for maintaining said post in said raised position.

14. A vehicle anti-theft parking space device according to claim 13, wherein said engagement means includes a slide member mounted on said post for engaging against an inner wall of said receptacle base.

15. A vehicle anti-theft parking space device according to claim 13, wherein said engagement means includes a slide member mounted in said receptacle base for engaging against an outer wall of said post.

16. A vehicle anti-theft parking space device according to claim 1, wherein said locking means includes a padlock, said padlock being removably engaged through said second a hole in said hasp.

17. A vehicle anti-theft parking space device, comprising:

a hollow receptacle base for mounting underground in a vertical position extending downwardly from ground level;

a vertically slideable hollow post telescopingly received in said receptacle base so that said post can be lowered into said receptacle base and raised out of said receptacle base to a raised position above ground level;

said post including a vertically extending slot provided through a wall of said post, said slot being positioned out of said receptacle base when said post is in said raise position;

a hasp pivotally mounted within said post so that said hasp freely pivots through said slot into a horizontal position extending outwardly from said post when said post is in said raised position;

locking means for securing said hasp in said horizontal position to prevent said post from being lowered into said receptacle base;

said hasp having a first hole at one end thereof to receive a first pin secured within said post so that said hasp can pivot around said first pin, a tongue portion being provided on an opposite free end of said hasp, and a second hole being provided between said first hole and said tongue portion to receive said locking means;

stop means being provided in said post to prevent said hasp from pivoting passed a vertical position of said hasp directly above said first pin; and said stop means including a second pin disposed adjacent to said slot for engaging said tongue portion of said hasp.

18. A vehicle anti-theft parking space device, comprising:

a hollow receptacle base for mounting underground in a vertical position extending downwardly from ground level;

a vertically slideable hollow post telescopingly received in said receptacle base so that said post can be lowered into said receptacle base and raised out of said receptacle base to a raised position above ground level;

said post including a vertically extending slot provided through a wall of said post, said slot being positioned out of said receptacle base when said post is in said raised position;

a hasp pivotally mounted within said post so that said hasp freely pivots through said slot into a horizontal position extending outwardly from said post when said post is in said raised position;

locking means for securing said hasp in said horizontal position to prevent said post from being lowered into said receptacle base;

engagement means for maintaining said post in said raised position, said engagement means including a slide member mounted on said post for engaging against an inner wall of said receptacle base; and said slide member being connected to spring means for forcing said slide member against said inner wall of said receptacle base.

19. A vehicle anti-theft parking space device, comprising:

a hollow receptacle base for mounting underground in a vertical position extending downwardly from ground level;

a vertically slideable hollow post telescopingly received in said receptacle base so that said post can be lowered into said receptacle base and raised out of said receptacle base to a raised position above ground level;

said post including a vertically extending slot provided through a wall of said post, said slot being positioned out of said receptacle base when said post is in said raised position;

a hasp pivotally mounted within said post so that said hasp freely pivots through said slot into a horizontal position extending outwardly from said post when said post is in said raised position;

locking means for securing said hasp in said horizontal position to prevent said post from being lowered into said receptacle base;

engagement means for maintaining said post in said raised position, said engagement means including a slide member mounted in said receptacle base for engaging against an outer wall of said post; and said slide member being connected to spring means for forcing said slide member against said outer wall of said post.

* * * * *